US005438938A

United States Patent [19]

Meeker et al.

[11] Patent Number: 5,438,938

[45] Date of Patent: Aug. 8, 1995

[54] CART WITH REMOVABLE TRAY ASSEMBLY

[75] Inventors: Paul K. Meeker, Hiram; William R. Gibson, Canton, both of Ohio

[73] Assignee: Cosco, Inc., Columbus, Ind.

[21] Appl. No.: 182,445

[22] Filed: Jan. 14, 1994

[51] Int. Cl.[6] ..... A47B 7/00

[52] U.S. Cl. ..... 108/91; 108/127; 108/159; 108/180; 211/153

[58] Field of Search ..... 108/91, 92, 97, 182, 108/180, 157, 159, 127; 211/187, 153; 297/151, 153

[56] References Cited

U.S. PATENT DOCUMENTS

| | | | |
|---|---|---|---|
| 1,778,075 | 10/1930 | Harris | 211/153 |
| 3,072,451 | 1/1963 | Greenberg et al. | 108/132 |
| 3,096,732 | 7/1963 | Wilkinson | 108/127 |
| 3,123,935 | 3/1964 | Williams | 108/127 X |
| 3,490,808 | 1/1970 | Siegel | 297/153 |
| 3,885,846 | 5/1975 | Chuang et al. | 211/187 X |
| 4,098,486 | 7/1978 | Hornsby | 108/159 X |
| 4,627,543 | 12/1986 | Nicely | 211/187 |
| 4,763,799 | 8/1988 | Cohn et al. | 211/187 |
| 4,936,628 | 6/1990 | Delancy et al. | 297/153 X |
| 4,953,473 | 9/1990 | Tomaka et al. | 108/127 X |

FOREIGN PATENT DOCUMENTS

| | | | |
|---|---|---|---|
| 3038539 | 5/1981 | Denmark | 108/180 |
| 747877 | 6/1933 | France | 108/157 |

*Primary Examiner*—Kenneth J. Dorner
*Assistant Examiner*—Janet M. Wilkens
*Attorney, Agent, or Firm*—Barnes & Thornburg

[57] ABSTRACT

A movable utility cart includes a frame and a tray assembly appended to the frame. A latch assembly is provided to move between an engaged position coupling the tray assembly to the frame and a disengaged position uncoupling the tray assembly from the frame.

56 Claims, 5 Drawing Sheets

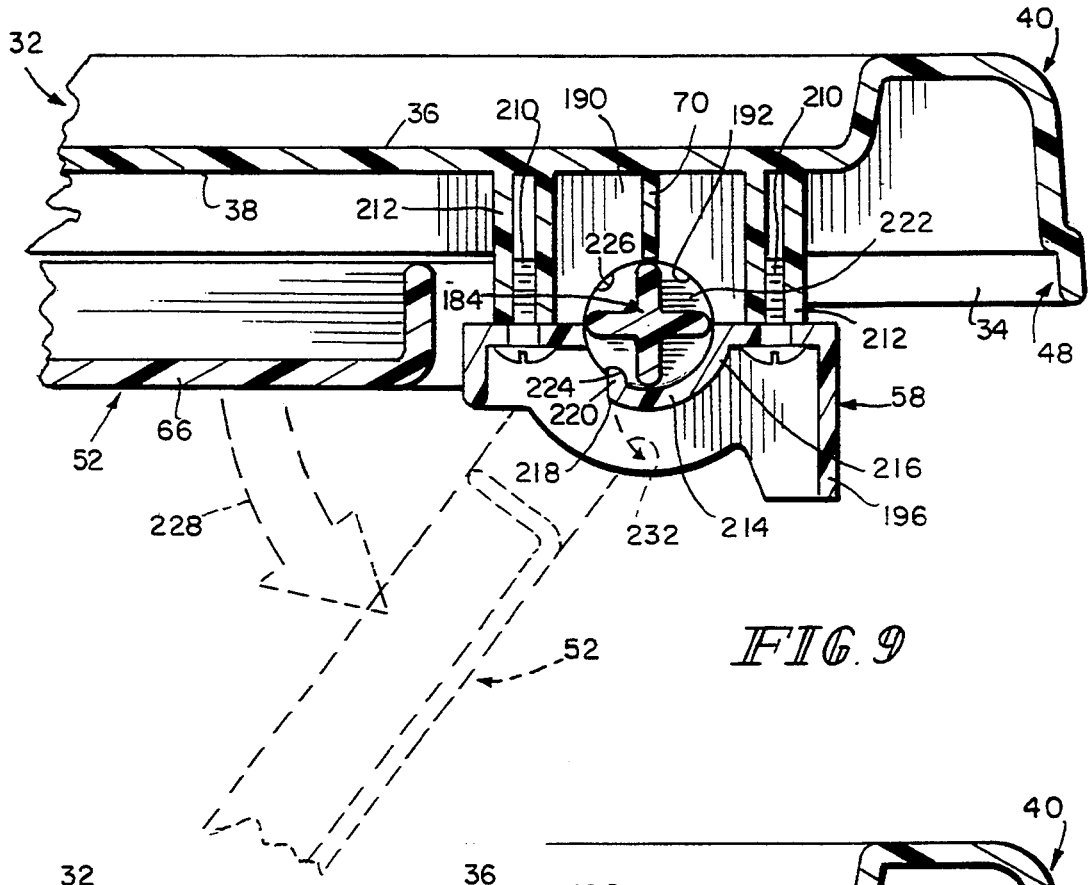
FIG. 9
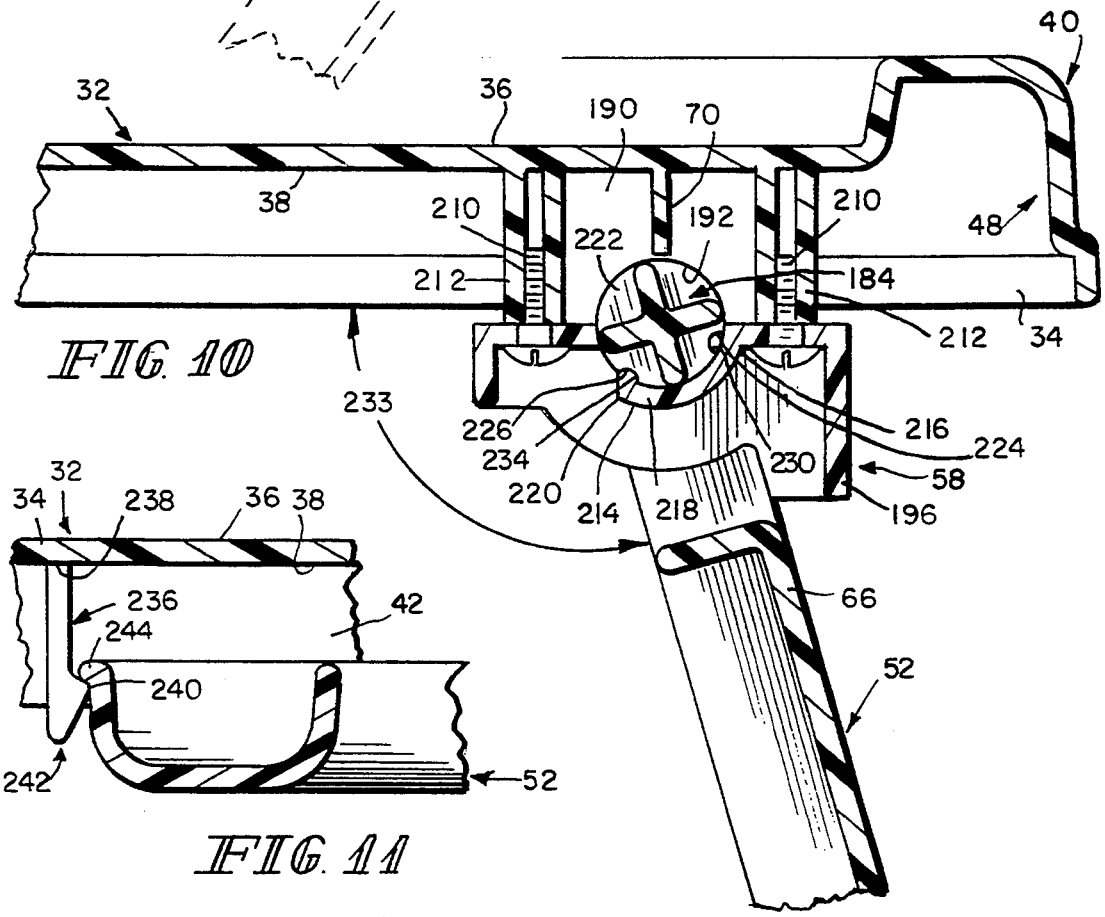
FIG. 10
FIG. 11

CART WITH REMOVABLE TRAY ASSEMBLY

BACKGROUND AND SUMMARY OF THE INVENTION

The present invention relates to a cart and, in particular, to a cart having a frame that includes at least one shelf and a tray assembly coupled to the frame above the shelf. More particularly, the present invention relates to a tray assembly that is removable from the cart frame so that the tray assembly can be used as a serving tray or lap tray away from the cart.

Shelf structures and carts have a variety of uses around a home, office, or other work place. These devices typically include vertically extending legs to which one or more fixed shelves are attached. The legs and shelves together form a frame. Each shelf includes a surface on which items may be placed for display and storage.

Carts often include wheeled casters that are attached to the lower end of each of the legs. These wheeled casters enhance the mobility of a cart so that the items on the cart shelves can be simultaneously and more easily transported from one location to another by a user pushing the cart.

Transferring items from a cart shelf to a separate tray to expedite delivery of the items can be a cumbersome and time-consuming activity. If many items must be transferred, someone must find a place to set the tray next to the cart and the time and place to move the items from the cart shelf to the separate serving tray. Individual transfer of several items from a cart to a serving tray can involve considerable expenditure of time and, thus, quickly becomes inefficient. Another problem arises if additional tray storage space is not available to hold a tray when such tray is not in use.

Conventional tray assemblies typically include a tray having a table surface and a bottom surface. One type of tray assembly includes support legs on the bottom surface to elevate its table surface and another type of tray assembly has a generally flat bottom surface without any support legs.

Free-standing tray assemblies typically include two or more support legs coupled to the bottom surface of the tray. Short free-standing tray assemblies are used for such things as bed trays where a meal on the table surface of the tray can be enjoyed by an individual who is bedridden due to an illness. Tall free-standing trays are used as "TV trays" where an individual can enjoy a meal in a relaxed setting away from a dining room. In some designs, tray support legs are movable from a retracted position, where the legs are folded to lie flat against the bottom surface of the tray, to an extended position, where the legs are unfolded to project at an angle away from the bottom surface of the tray. The retracted position allows the tray assembly to be stored more easily, while the extended position allows the tray assembly to be self-supporting.

One problem with tray assemblies, free-standing or otherwise, is that they must be stored when not in use. Adequate storage space or a special rack must be provided to hold such tray assemblies when not in use. Both storage space and tray racks add to the expense associated with tray assemblies.

A cart or other shelf structure that incorporated a removable tray assembly as one of its shelves would allow the advantages of both to be exploited while, at the same time, reducing the above-described disadvantages associated with using separate carts and trays. Transportable items could be initially stored on the table surface of the tray assembly mounted on the cart. These items could be moved away from the cart, when desired, by removing the tray assembly from the cart frame and moving the tray to the desired location. The remaining shelves of the shelf structure or cart would still be employable for storage and display of other items. The frame of the shelf structure or cart would serve as a mounting fixture on which to store the tray assembly when not in use.

According to the present invention, a shelf structure includes a frame and a tray assembly. The shelf structure further includes means for mounting the tray assembly to the frame so that the tray assembly is connected to the frame and means for uncoupling the tray assembly from the frame so that a user can lift the tray assembly off of the frame to disconnect the mounting means from the frame.

In preferred embodiments, the frame includes four legs and at least one shelf coupled to the legs so that the frame is a free-standing structure. The shelf has a shelf surface on which items may be placed for storage and display. One of the ends of each of the legs may rest on a floor or other surface for support. Preferably, the shelf structure is a push cart having wheeled casters connected to the support ends of each of the legs of the frame. These wheeled casters allow the cart to be moved easily so that items stored and displayed on the one or more shelf surfaces can be transported from one place to another.

The tray assembly includes a tray having an upwardly facing table surface on which items are placed and a downwardly facing bottom surface. The bottom surface of the tray includes a plurality of leg mounts that are each configured to include a cavity that receives one of the top ends of each of the legs. The leg mounts allow the tray assembly to be connected to the top of the shelf structure above the shelf surface of the shelf immediately below to form the top tier of the shelf structure.

A pair of latch assemblies are attached to the bottom surface of the tray assembly that are configured to couple and uncouple the tray assembly to the frame of the shelf structure. Each latch assembly includes at least one latch and means for guiding each latch between a locked position engaging the frame to couple the tray assembly to the frame and an unlocked position disengaged from the frame to uncouple the tray assembly from the frame.

Each leg of the shelf structure is formed to include a latch-receiving slot. Each latch assembly is configured to include a handle. The handle allows the latch or latches of each latch assembly to be manually moved between a locked position engaging one of the latch-receiving slots and an unlocked position disengaging the latch-receiving slot. The latch handles also provide a convenient means for carrying the tray assembly when it is disconnected from the shelf structure.

The latch assemblies are biased so that the latches are urged to their locked positions. One or more springs are used to bias each of the latches to its locked position. Each of these springs is positioned to lie in a spring pocket formed between a latch assembly and the tray bottom surface. Each latch of the biased latch assemblies is moved against its spring to its unlocked position. The latches are moved simultaneously to an unlocked position by manually applying a force to each of the handles in a direction generally opposite the force applied by the springs.

In a preferred embodiment, a rounded cap is mounted on the top of each leg and each cap is formed to include a latch-receiving slot. Essentially, the rounded top portion of the cap acts as a cam and functions to cam each spring-biased latch toward its tray-releasing position during mounting of the tray on the legs. By providing such a latch cam mechanism on each leg, a user can install the tray simply by positioning the tray in a proper position above the legs and pushing down on the tray until the spring-loaded latches are cammed to a tray-releasing position and then snap back into the latch-receiving slots formed in the leg caps.

The tray assembly further includes a pair of tray stands coupled to the bottom surface of the tray. Each tray stand is movable between a retracted position adjacent the bottom surface and an extended position supporting the tray. The extended position makes the tray assembly suitable for use, for example, as a bed or "TV" tray. The tray stands are typically moved to the retracted position when the tray is connected to the cart so that they are out of the way of objects stored on the shelf surface of the immediately lower shelf. Tray stand clamp assemblies couple the tray stands to the bottom surface of the tray and secure them in the retracted position as well as the extended position.

Each tray stand includes a pair of legs that are connected together by a cross-brace which is configured to include a raised portion. At least one snap lock is cantilevered to the bottom surface of the tray adjacent the position assumed by each cross-brace when the tray stands are in the retracted position. The snap locks engage the raised portions of the cross-braces to help secure the tray stands in the retracted position.

The tray assembly can be easily reconnected and coupled to the shelf structure when it is no longer desired to use the tray separately. First, the tray stands are moved to the retracted position. A user locates the tray in a proper position so that the top ends of the legs are inserted into the downwardly facing leg mount cavities of the tray assembly to connect the tray assembly to the frame. The user pushes down on the tray so that the latches are moved against their springs to their tray-releasing positions. The latches are urged automatically by their springs to their tray-locking positions into the slots formed in the leg caps. This couples the tray assembly to the frame of the shelf structure.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 9 is a view taken along line 9—9 of FIG. 4 showing a support leg of the tray stand coupled to the bottom surface of the tray and secured in a retracted position adjacent the bottom surface by a tray stand clamp assembly having a detent engaged in a first notch formed in an axle of the support leg and showing (in phantom lines) the support leg as it is moved toward its extended position;

FIG. 10 is a view similar to FIG. 9 showing the support leg after it has been secured in an extended tray-supporting position away from the bottom surface of the tray by engagement of the detent in a second notch formed in the support leg axle; and FIG. 11 is an enlarged view taken along line 11—11 of FIG. 4 showing a snap lock formed on and projecting away from the bottom surface of the tray to engage a ledge formed on a support leg cross-brace to help retain the tray stand in the retracted position shown in FIGS. 4 and 9.

DETAILED DESCRIPTION OF THE DRAWINGS

Figure 1:
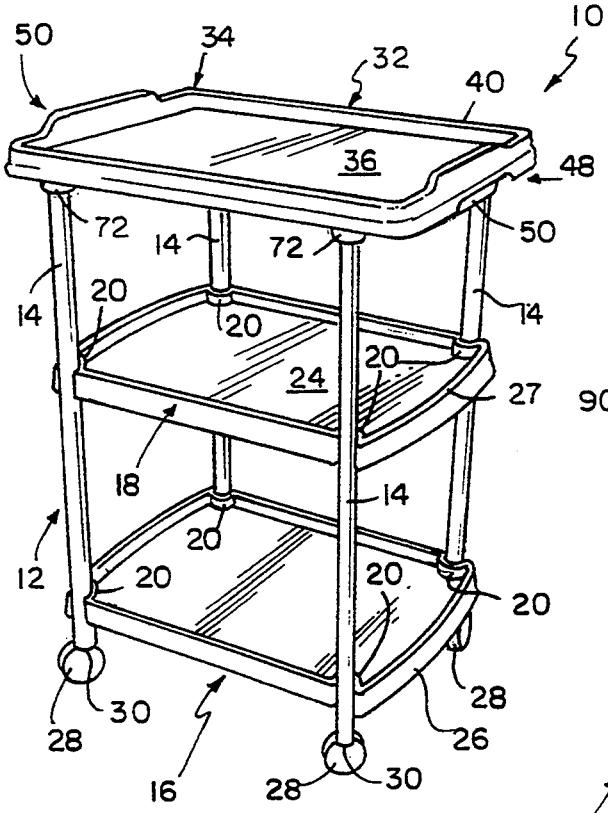
FIG. 1 is a perspective view of a multi-tiered serving cart with a removable top tray assembly in accordance with the present invention showing a frame including four vertically extending wheeled legs and two lower shelves attached to the legs and a removable tray assembly coupled to the top ends of the legs and positioned to lie above the two lower shelves to form the top tier of the serving

A multi-tiered cart 10 for storage and display of items in a home or commercial environment is shown in FIG. 1. Cart 10 includes a frame 12 having four vertically extending legs 14, a lower shelf 16 coupled to legs 14, and a middle shelf 18 coupled to legs 14 and positioned to lie above the lower shelf 16. Each of the lower and middle shelves 16 and 18 are formed to include recessed corners 20 that receive legs 14. Various items (not shown) may be placed on shelf surface 22 of the lower shelf 16 and/or shelf surface 24 of middle shelf 18 for storage or display. Raised borders 26 and 27 are respectively formed on the perimeters of lower shelf 16 and middle shelf 18. Borders 26 and 27 help retain items (not shown) on shelves 16 and 18.

Wheeled casters 28 are attached to the lower ends 30 of legs 14 to enhance mobility of cart 10. Although a preferred embodiment of cart 10 includes wheeled casters 28, cart 10 can also be constructed so as to be a generally stationary shelf unit, supported directly on a surface, such as a floor, by the lower ends 30 of legs 14.

A removable tray assembly 32 is coupled to legs 14 of frame 12 to provide a top shelf as shown in FIG. 1. Tray assembly 32 includes a tray 34 having a table surface 36. Various items (not shown) may be placed on table surface 36 for storage and display. A raised border 40 is formed around the perimeter of tray 34 to help retain items (not shown) on table surface 36.

Figure 2:
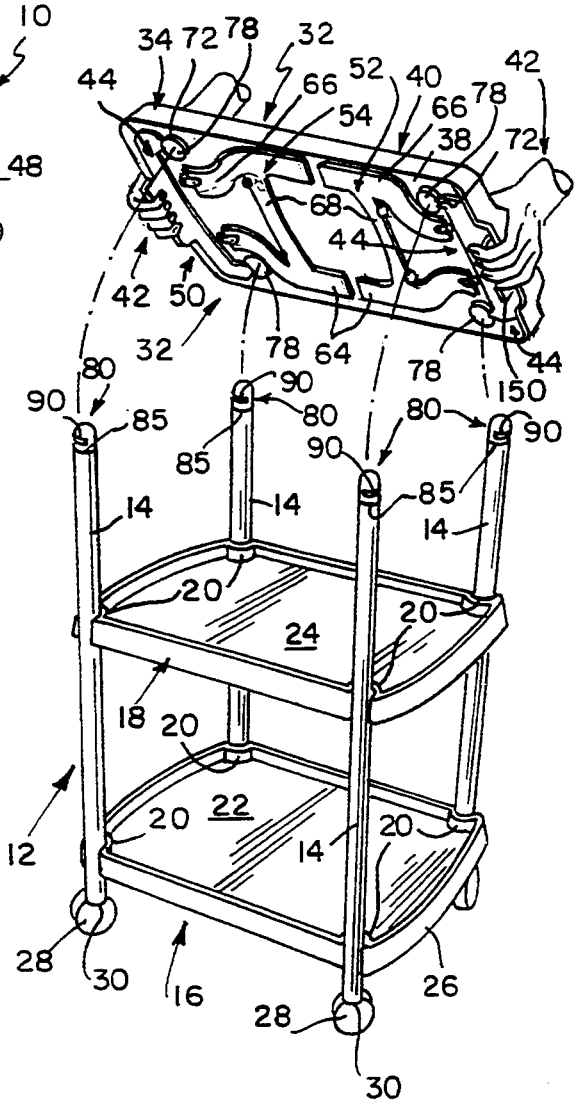
FIG. 2 is a view similar to FIG. 1 showing the underside of the removable tray assembly after it has been uncoupled from the top ends of the four legs following manual movement of the spring-loaded latch assemblies located on a bottom surface of the tray to an unlocked position.

Tray assembly 32 can be manually uncoupled and removed from legs 14 of frame 12 as shown in FIG. 2 so that cart 10 and tray assembly 32 can be used apart from one another. A person using the tray assembly 32 can use their hands 42 to move latch assemblies 44 and 46 to an unlatched or unlocked tray-releasing position to effect this uncoupling. Latch assemblies 44 and 46 are attached to bottom surface 38 of tray 34 at respective opposing tray ends 48 and 50 as shown in FIG. 2 and discussed in more detail below.

Figure 3:
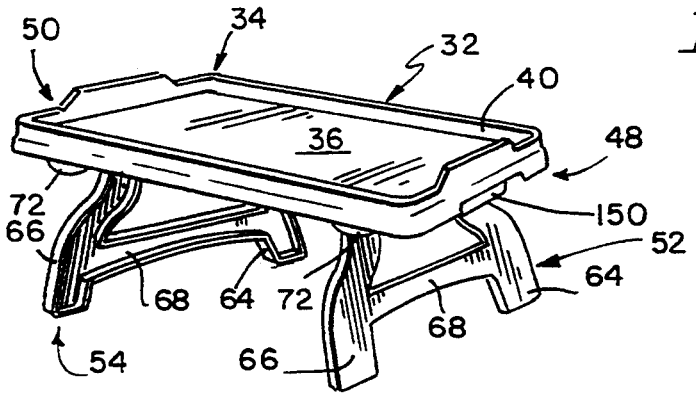
FIG. 3 is a perspective view of the removable tray assembly of FIG. 2 after its support legs have been moved from the retracted position shown in FIG. 2 to a spread-apart extended position.

Tray stands 52 and 54 are movable from a retracted position shown in FIG. 2 to an extended position shown in FIG. 3 to permit tray assembly 32 to be free-standing and self-supporting. This allows tray assembly 32 to be used, for example, as a bed or "TV" tray when uncoupled and removed from legs 14 of frame 12. Tray stands 52 and 54 are preferably stored in their retracted position when tray assembly 32 is coupled to legs 14 of frame 12 so as to keep the space above shelf surface 24 free for placement and storage of items. Tray stands 52 and 54 are coupled to bottom surface 38 of tray 34 adjacent and between respective latch assemblies 44 and 46 as discussed more fully below.

Figure 4:
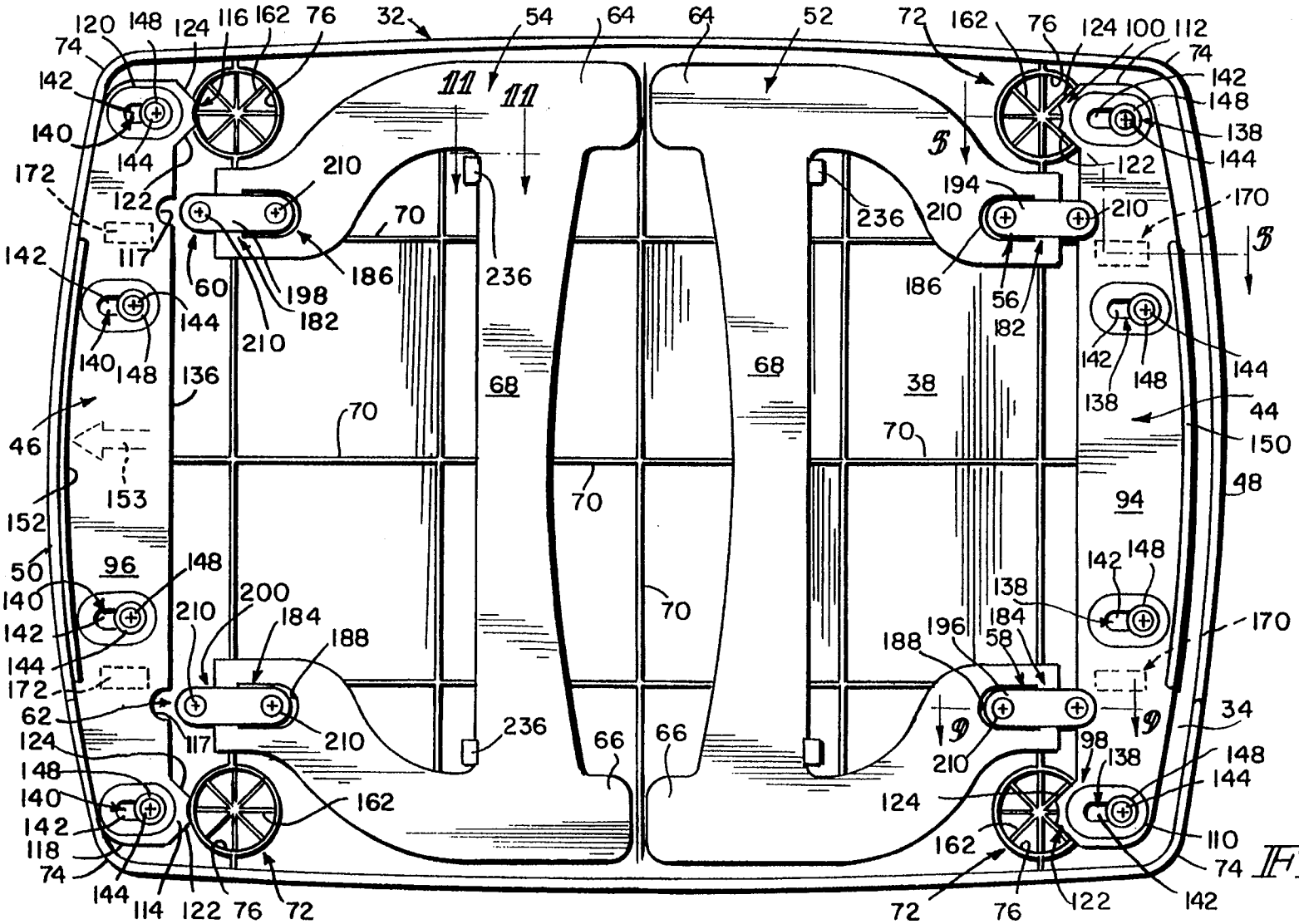
FIG. 4 is a bottom view of the removable tray assembly of FIG. 2 showing a latch assembly at each end of the tray, a pair of H-shaped support legs mounted to the bottom surface of the tray assembly and positioned to lie between the two spaced-apart latch assemblies, and four circular leg mounts adjacent the corners of the bottom surface of the tray.

The relative positions of latch assemblies 44 and 46 as well as tray stands 52 and 54 on bottom surface 38 of tray 34 are shown in FIG. 4. As discussed above, latch assemblies 44 and 46 are coupled to bottom surface 38 of tray 34 at opposing tray ends 48 and 50. Tray stand 52 is coupled to bottom surface 38 of tray 34 and located adjacent latch assembly 44 by means of tray stand clamp assemblies 56 and 58. Tray stand 54 is coupled to bottom surface 38 of tray 34 and located adjacent latch assembly 46 by means of tray stand clamp assemblies 60 and 62.

The generally H-shaped tray stands 52 and 54 include pairs of support legs 64 and 66 that are coupled together by a cross-brace 68. Cross-braces 68 help provide lateral stability to support legs 64 and 66 of tray stands 52 and 54.

A matrix of ribs 70 on bottom surface 38 provide strength reinforcement to tray 34 allowing it to be formed of thinner material than would otherwise be possible absent ribs 70. Ribs 70 are formed along the length and width of bottom surface 38 of tray 34 as shown in FIG. 4.

Figure 5:
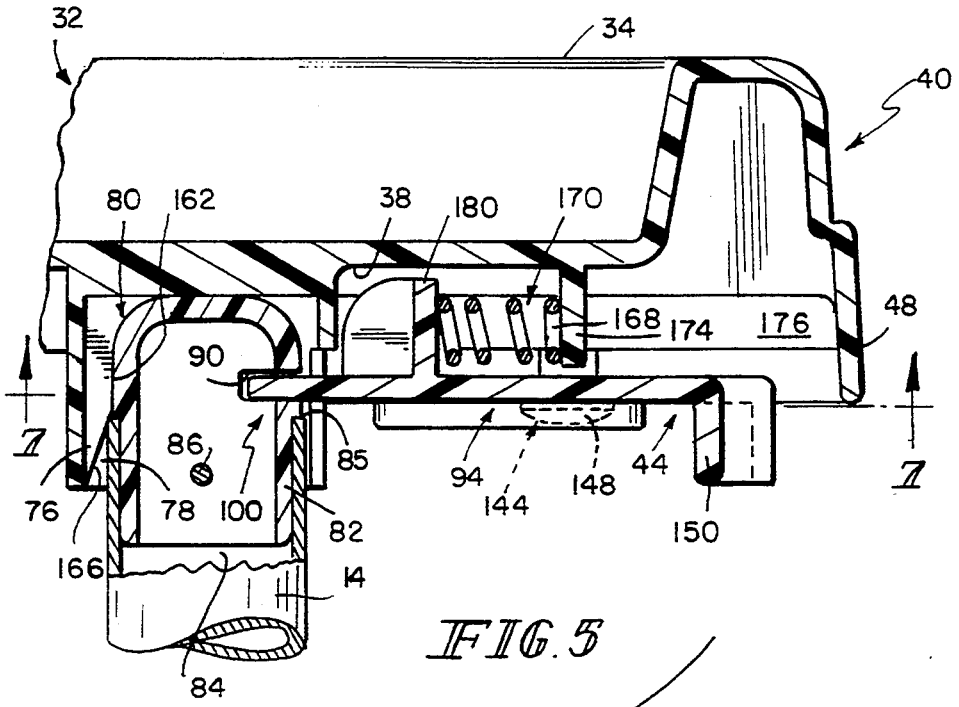
FIG. 5 is a view taken along line 5—5 of FIG. 4 showing a spring-biased latch of one of the latch assemblies in its tray-locking position engaging a slot formed in a slotted cap appended to the top of one of the frame legs to secure the tray assembly to the top of the cart.
Figure 6:
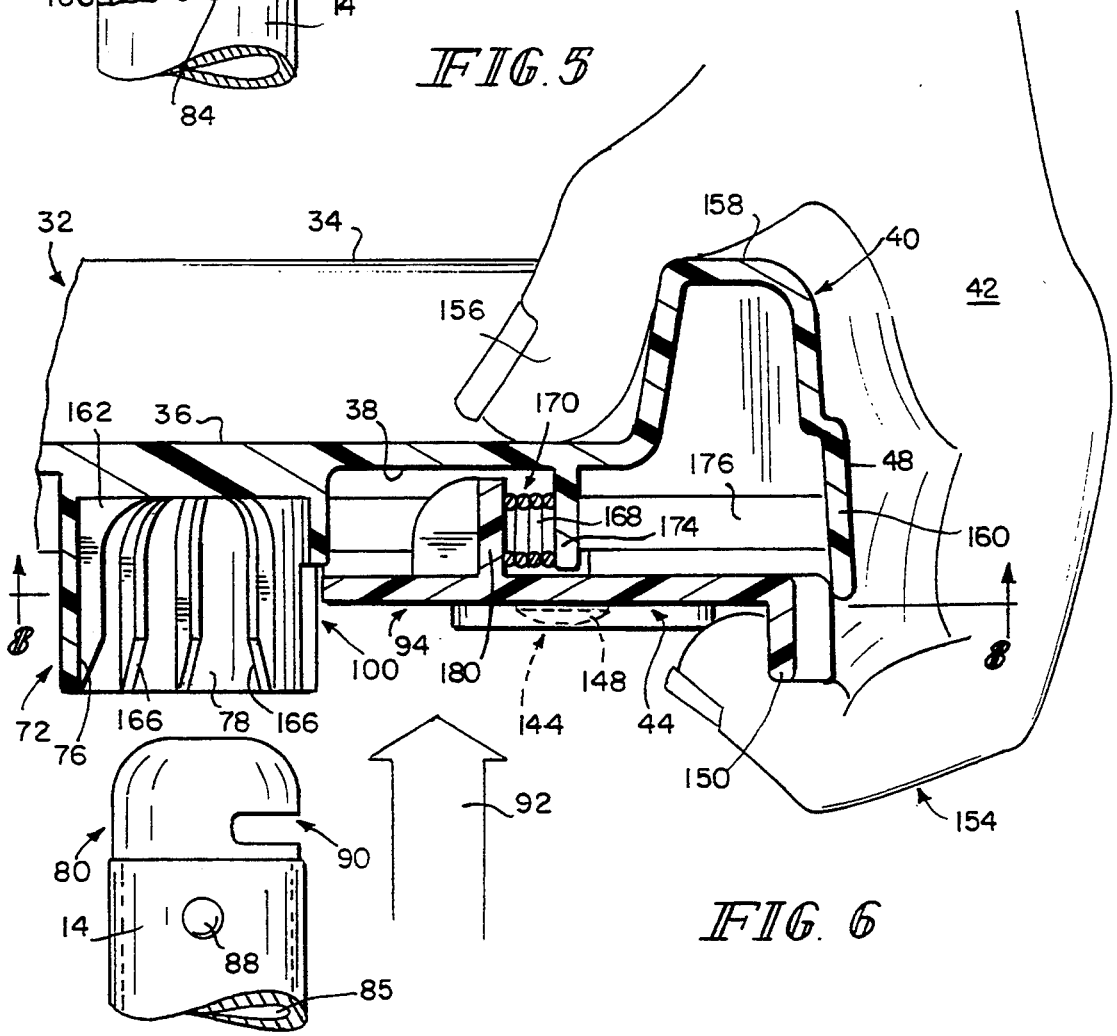
FIG. 6 is a view similar to FIG. 5 showing hand-operated movement of the spring-biased latch to its tray-releasing position to disengage the latch from the slot formed in the slotted cap so that the tray assembly can be removed from the serving cart in a direction generally indicated by the large vertical arrow.

Leg mounts 72 are used to connect tray assembly 32 to legs 14 of frame 12 and have a wagon wheel appearance as shown in FIGS. 5 and 6. Leg mounts 72 also facilitate proper orientation of tray assembly 32 onto legs 14 of frame 12. Leg mounts 72 are generally circular in shape as shown in FIG. 4 and lie near corners 74 of tray 34. Leg mounts 72 project downwardly away from bottom surface 38 of tray 34 and each mount 72 includes interior surfaces 76 that define a leg-receiving cavity 78. Top ends 85 of legs 14 each fit into one of the cavities 78.

Caps 80 on top of each leg 14 make it easy for a user of tray assembly 32 to mount tray assembly 32 onto cart 10 as shown in FIG. 5. Each cap 80 is configured to include a plug end 82 that is inserted into a cavity 84 formed in top end 85 of one of the legs 14. Each plug end 82 is configured to include a detent 86 that engages a cap-securing notch 88 formed in each leg 14 to retain caps 80 on legs 14. Each cap 80 is formed to include a latch-receiving slot 90 for receiving either latch assembly 44 or 46. Each cap 80 also includes a rounded top portion above the latch-receiving slot 90. This rounded top portion functions as a cam to move a latch engaging the cap 80 temporarily to its tray-releasing position during installation of the tray 34 onto the legs 14.

Latch assemblies 44 and 46 are both movable between a locked tray-locking position shown in FIG. 5 and an unlocked tray-releasing position shown in FIG. 6. The tray-locking position couples tray assembly 32 to legs 14 of cart 10 and the tray-releasing position uncouples tray assembly 32 from legs 14 of cart 10 so that a user may disconnect it from frame 12 by moving it in the general direction of large vertical arrow 92 as shown in FIG. 6.

Latch assemblies 44 and 46 include respective latch plates 94 and 96 that are generally flat and coupled to bottom surface 38 of tray 34 adjacent tray ends 48 and 50 as shown in FIGS. 2 and 4–6. Latch plate 94 is configured to include latches 98 and 100 located at respective ends 110 and 112 as shown in FIG. 4. Latch plate 96 is configured to include latches 114 and 116 located at respective ends 118 and 120 as also shown in FIG. 4. Latches 98, 100, 114, and 116 are placed in latch-receiving slots 90 of caps 80 to couple tray assembly 32 to legs 14 of cart 10. Notches 117 are formed in latch plates 94 and 96 to provide clearance for tray stand clamp assemblies 56, 58, 60 and 62 as shown in FIG. 4.

Figure 7:
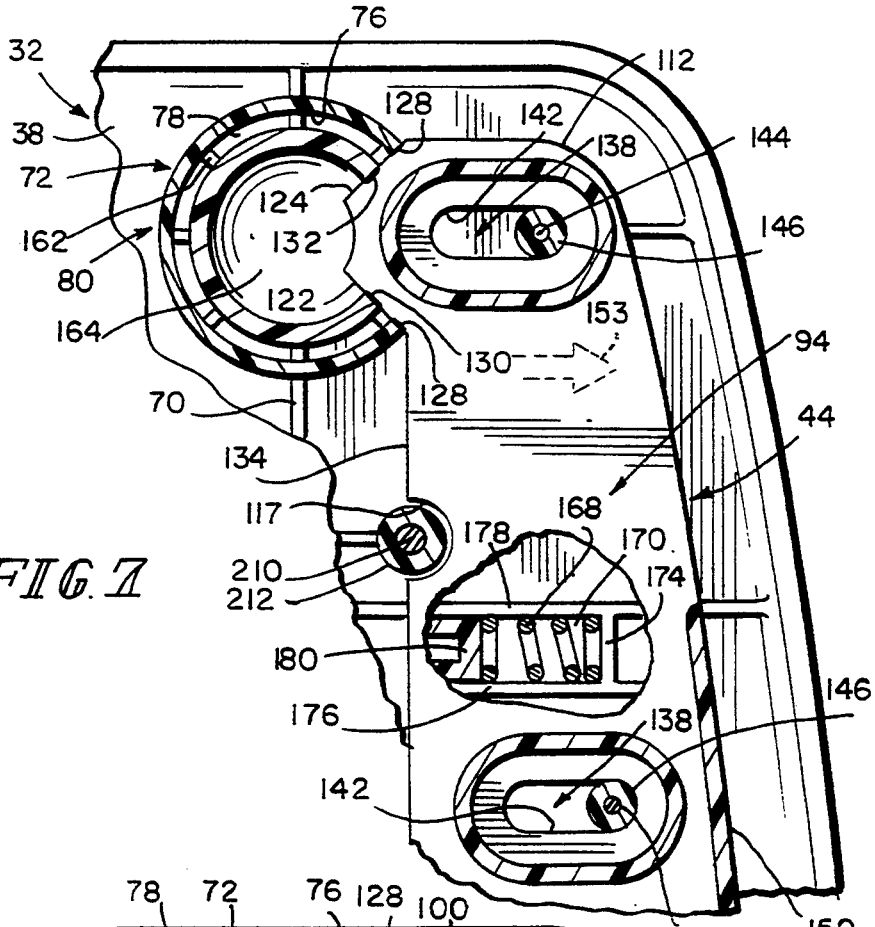
FIG. 7 is a view taken along line 7—7 of FIG. 5 showing a bottom view of the latch assembly shown in FIG. 5 with portions broken away to show an uncompressed latch-biasing spring.
Figure 8:
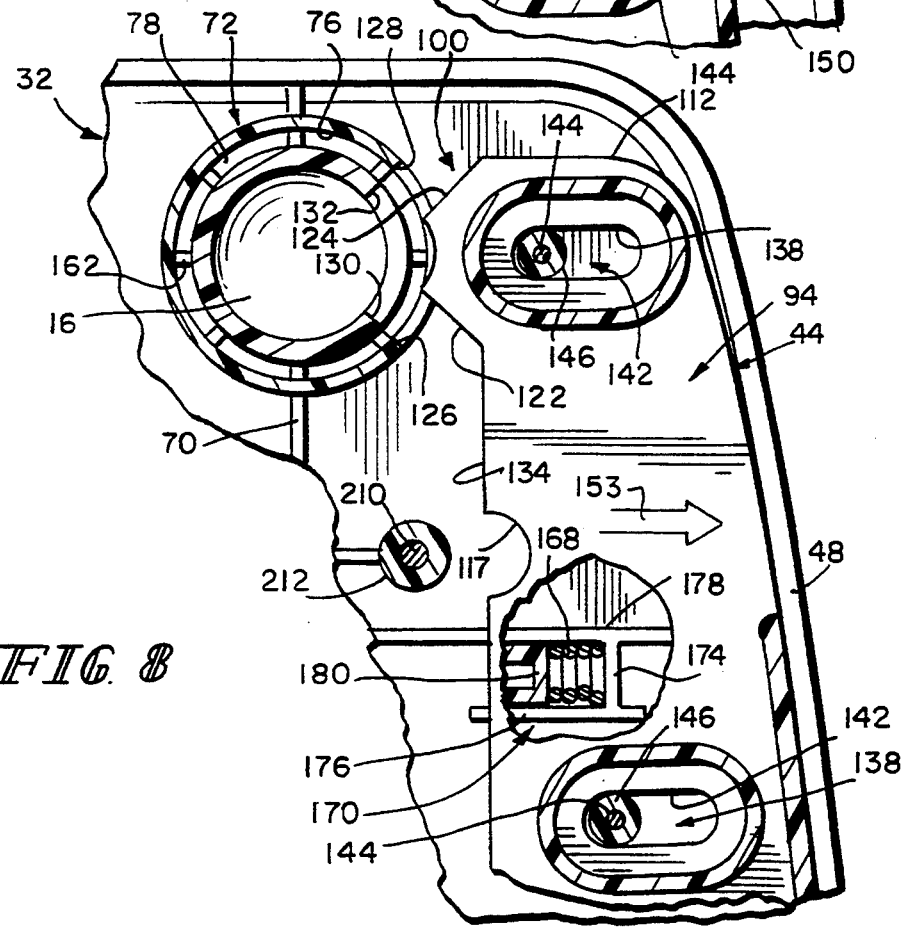
FIG. 8 is a view taking along line 8—8 of FIG. 6 showing a bottom view of the latch assembly shown in FIG. 6 with portions broken away to show a compressed latch-biasing spring.

Latches 98, 100, 114, and 116 are easily movable into and out of slots 90 to couple and uncouple tray assembly 32 to and from legs 14 of cart 10. Each latch is configured to include tapering sides 122 and 124 as shown in FIG. 4. Tapering sides 122 and 124 of latches 98, 100, 114, and 116 are formed so as to positively engage sides 126 and 128 of leg mounts 72 as well as sides 130 and 132 of slotted caps 90 as shown in FIGS. 7 and 8. The angle of tapering sides 122 and 124 permits latches 98, 100, 144, and 116 to be movable freely into and out of slots 90 while, at the same time, resisting movement of tray assembly 32 in a direction generally indicated by large vertical arrow 92 (see FIG. 6) when latches 98, 100, 114, and 116 are inserted into slots 90.

While latches 98, 100, 114, and 116 are shown as having a generally chiseled shape, other shapes are possible. For example, latches 98, 100, 114, and 116 could be generally straight and parallel with edges 134 and 136 of respective latch plates 94 and 96. Alternatively, latches 98, 100, 114, and 116 could be replaced by edges 134 and 136 of respective latch plates 94 and 96. In addition, it should be noted that caps 80 are not necessary for the operation of the present invention. That is, latch-receiving slots 90 may be formed adjacent top ends 85 of each leg 14 to receive latches 98, 100, 114, and 116 or the above-described alternative embodiments for these latches. However, in such a case, it might be necessary for a user to use both handles 150, 152 to retract the latches far enough to clear the legs before releasing the latches so that they can snap back into the latch-receiving slots.

Guiding structure 138 and 140, as shown in FIGS. 4, 7, and 8, attaches respective latch assemblies 44 and 46 to bottom surface 38 of tray 34 and allows them to be moved between locked and unlocked positions into and out of slots 90 of caps 80. Guiding structure 138 includes latch plate slots 142 formed in latch plate 94 and latch plate fasteners 144 that are inserted through each of slots 142 and threadingly engaged in bosses 146 formed on bottom surface 38 of tray 34 as shown in FIGS. 4, 7, and 8. Fasteners 144 each include heads 148 that extend beyond the width of slots 142 to attach plates 94 and 96 to tray 34 as shown in FIG. 4 and guide latches 98, 100, 114, and 116 into and out of slots 90 of caps 80 as shown in FIGS. 4–8.

Handles 150 and 152 allow respective latch assemblies 44 and 46 to be moved manually into slots 90 of caps 80 to couple tray assembly 32 to legs 14 of cart 10 as shown in FIGS. 4, 5, and 7 and out of slots 90 of caps 80 to uncouple tray assembly 32 from legs 14 of cart 10 as shown by arrow 153 in FIGS. 4, 7, and 8. Handle 150 is formed on and projects away from latch plate 94 adjacent tray end 48. Handle 152 is formed on and projects away from latch plate 96 adjacent tray end 50.

Manual movement of latches 98, 100, 114, and 116 is effected by engagement of handles 150 and 152 with hands 42 as shown in FIGS. 2 and 6. Handles 150 and 152 also provide a convenient means for transporting tray assembly 32 when it is disconnected from legs 14 of cart 10. Fingers 154 of the user's hands 42 are curled around handles 150 and 152 and the user's thumb 156 is curled around top edge 158 and side wall 160 of raised border 40 to provide leverage for the user's fingers 154 as shown in FIG. 6.

Centering ribs 162 position slotted caps 80 and top ends 85 of legs 14 generally within the center point 164 of leg mount cavities 78 as shown in FIGS. 7 and 8. Centering ribs 162 are formed around interior surface 76 of each leg mount 72 and radially project towards center point 164 of leg mounts 72 as shown in FIGS. 5–8. A ramp 166 is formed on each centering rib 162 to help guide slotted caps 80 and top ends 85 of legs 14 within leg mount cavities 78 as shown in FIGS. 5 and 6.

A preferred embodiment of latch assembly 44 is biased in the tray-locking position shown in FIGS. 4, 5, and 7 by expanded springs 168. Although not shown, latch assembly 46 is also biased by springs 168. Biasing latch assemblies 44 and 46 to their tray-locking positions prevents inadvertent uncoupling of tray assembly 32 from legs 14 of cart 10. A manual force must be applied by hands 42 in the direction generally indicated by arrow 153 in FIGS. 4, 7, and 8 to compress springs 168 as shown in FIGS. 6 and 8 to uncouple latch assemblies 44 and 46 from legs 14 of cart 10.

Springs 168 are inserted in spring pockets 170 defined between latch assembly 44 and bottom surface 38 of tray 34 adjacent latch assembly 44 as shown in FIGS. 4–8. Springs 168 for latch assembly 46 are inserted within spring pockets 172 defined between latch assembly 46 and bottom surface 38 of tray 34 adjacent latch assembly 46 as shown in FIG. 4.

Each spring pocket 170 is defined by a downwardly extending tray assembly flange 174 and side walls 176 and 178, both of which are formed on and project away from bottom surface 38 of tray 34, and an upwardly extending tray assembly flange 180 formed on latch assembly 44 and lying generally opposite and in spaced apart relation to flange 174 as shown in FIGS. 5–8. Although not shown, spring pockets 172 are formed by similar structure on latch assembly 46 and bottom surface 38 of tray 34 adjacent latch assembly 46.

Axles 182 and 184 are formed between respective forked portions 186 and 188 of respective support legs 64 and 66 in conjunction with clamp assemblies 56, 58, 60, and 62 and axle supports 190 to mount tray stands 52 and 54 for rotation between the retracted position adjacent bottom surface 38 of tray 34, shown in FIGS. 2, 4, 9, and 11, and an extended position away from bottom surface 38, as shown in FIGS. 3 and 10. As shown in FIGS. 9 and 10, axle supports 190 are formed on and project away from bottom surface 38 of tray 34 adjacent the location of tray stand clamp assemblies 56, 58, 60, and 62. Each axle support 190 is configured to include an axle groove 192 into which either axle 182 or 184 is positioned to lie. Axle supports 190 help rotatably support axles 182 and 184 during movement of tray stands 52 and 54 between retracted and extended positions.

Tray stand clamp assemblies 56, 58, 60, and 62 each include respective clamp bodies 194, 196, 198, and 200 that are coupled to bottom surface 38 of tray 34 by fasteners 210. Fasteners 210 each engage a clamp assembly boss 212 formed on and projecting away from bottom surface 38 of tray 34 as shown in FIGS. 9 and 10.

Clamp bodies 194, 196, 198, and 200 capture axles 182 and 184 between a clip 214 formed on each clamp body 194, 196, 198, and 200 and an axle support 190 as shown in FIGS. 9 and 10. Each clip is cantilevered on a first end 216 to a clamp body 194, 196, 198, and 200. A second end 218 of each clip 214 is configured to include a clamp assembly detent 220 the purpose of which is described below.

Wheeled portions 222 of axles 182 and 184 are each configured to include a retracted leg retention notch 224 and an extended leg retention notch 226 as shown in FIGS. 9 and 10. Axles 182 and 184 are also formed to include reduced portions 228 that help minimize the amount of material necessary to construct axles 182 and 184.

Clamp assembly detent 220 snaps into retracted leg retention notch 224 to secure tray stands 52 and 54 in the retracted position adjacent bottom surface 38 of tray 34 as shown in FIG. 9 for tray stand 52. Movement of tray stand 52 in the direction generally indicated by large arrow 228 causes axle 184 and wheel portion 222 to rotate so that edge 230 of retracted leg retention notch 224 forces clamp assembly detent 220 and clip 214 in the direction generally indicated by arrow 232. Continued movement of tray stand 52 in the direction generally indicated by arrow 228 causes clamp assembly detent 220 to snap out of retracted leg retention notch 224. Further rotation of tray stand 52 in the direction generally indicated by arrow 232 will eventually place tray stand 52 in the extended position shown in FIGS. 3 and 10. Tray stand 52 is secured in the extended position by engagement of clamp assembly detent 220 within extended leg retention notch 226 as shown in FIG. 10. Tray stand 52 assumes an angle 223 of approximately 105 degrees relative to bottom surface 38 of tray 34 when in the extended position.

Although not shown, tray stand 52 can be returned to the retracted position adjacent bottom surface 38 of tray 34 by movement in a direction generally opposite that of large arrow 228 shown in FIG. 9. Movement in a direction generally opposite large arrow 228 causes edge 234 of extended leg retention notch 226 to move clamp assembly detent 220 and clip 214 in a direction generally indicated by arrow 232 out of extended leg retention notch 226. Continued movement of tray stand 52 in a direction generally opposite large arrow 228 eventually returns tray stand 52 to the retracted position where clamp assembly detent 220 engages retracted leg extension notch 224 as shown in FIG. 9. Although not shown, it should be noted that tray stand 54 and axles 182 and 184 thereof are configured to include both wheeled portions as well as retracted and extended leg retention notches. In addition, clamp bodies 198 and 200 include cantilevered clips with clamp assembly detents that engage the retracted and extended leg retention notches formed on axles 182 and 184. It should also be noted, that tray stands 52 and 54 can be moved independently of one another between respective retracted and extended positions.

Snap locks 236 help to further secure tray stands 52 and 54 in the retracted position as shown in FIGS. 4 and 11. Snap locks 236 are formed on and generally project away from bottom surface 38 of tray 34 adjacent the position assumed by cross-braces 68 when tray stands 52 and 54 are in the retracted position. Snap locks 236 each include a first end 238 that is cantilevered to bottom surface 38 as shown in FIG. 11. A snap lock flange 240 is formed on a second end 242 generally opposite first end 238. Cross-braces 68 are each configured to include a raised portion or ledge 244 as shown in FIG. 11. The cantilevering of snap locks 236 allows snap lock flanges 240 to be movable between a first position shown in FIG. 11, where they engage ledges 244 formed on cross-braces 68 to further secure tray stands 52 and 54 in the retracted position, and a second position, away from ledges 244, which allows tray stands 52 and 54 to be moved in a direction generally indicated by large arrow 228 in FIG. 9 to the extended position shown in FIG. 10.

Although the invention has been described in detail with reference to certain preferred embodiments, variations and modifications exist within the scope and spirit of the invention as described and defined in the following claims.

We claim:

1. A movable utility cart comprising a frame including a plurality of legs, a removable tray assembly, means for mounting the removable tray assembly to the frame so that the removable tray assembly is connected to the frame, latch means attached to the tray assembly for latching the tray assembly when mounted, and slidable actuation means attached to the tray assembly for unlatching and latching the latch means to permit removing of the removable tray assembly from the frame so that a user can lift the removable tray assembly off of the frame to disconnect the mounting means and the frame.

2. The movable utility cart of claim 1, wherein the slidable actuation means includes the latch means and means for guiding the latch means between a locked position engaging the frame to couple the removable tray assembly to the frame and an unlocked position disengaged from the frame to uncouple the removable tray assembly from the frame.

3. The movable utility cart of claim 2, wherein the frame includes a leg formed to include a slot and the latch means lies in the slot in the locked position.

4. The movable utility cart of claim 2, further comprising means for biasing the slidable actuation means so that the latch means is urged to the locked position.

5. The movable utility cart of claim 2, further comprising handle means for manually moving the latch means between the locked and unlocked positions.

6. The movable utility cart of claim 1, wherein the mounting means is on the removable tray assembly.

7. The movable utility cart of claim 6, wherein the mounting means is configured to receive a top end of at least one of the legs.

8. The movable utility cart of claim 6, wherein the mounting means includes a wall defining a cavity that receives a top end of at least one of the legs.

9. The movable utility cart of claim 1, further comprising tray stand means coupled to the removable tray assembly for supporting the removable tray assembly when disconnected from the frame so that the removable tray assembly is free-standing.

10. The movable utility cart of claim 9, further comprising means for securing the tray stand means in a retracted position adjacent the removable tray assembly and an extended position supporting the removable tray assembly.

11. The movable utility cart of claim 1, wherein the frame includes a lower portion adjacent to a floor surface and an upper portion spaced apart from the lower portion and further comprising at least one wheel appended to the lower portion of the frame and a stationary tray appended to the frame between the at least one wheel and the tray assembly.

12. The movable utility cart of claim 11, further comprising a second stationary tray appended to the frame between the first stationary tray and the tray assembly.

13. A movable utility cart comprising a frame having at least one vertical leg, a removable tray assembly, means for mounting the removable tray assembly directly to the at least one vertical leg so that the removable tray assembly is connected to the frame, and sliding latch means for alternatively engaging the at least one vertical leg of the frame in a locked position so that the removable tray assembly is coupled to the frame and disengaging the frame in an unlocked position so that the removable tray assembly is uncoupled from the frame, wherein the latch means is slidable relative to the vertical leg of the frame.

14. The movable utility cart of claim 13, wherein the leg is formed to include a slot and the latch means lies in the slot in the locked position.

15. The movable utility cart of claim 14, wherein the frame further includes a shelf and the leg is formed such that the slot is facing away from the shelf.

16. The movable utility cart of claim 13, further comprising a cap formed to include a slot and means for attaching the cap to a top end of the leg so that the latch means lies in the slot in the locked position.

17. The movable utility cart of claim 16, wherein the attaching means includes a detent on the cap positioned to lie in a notch formed in the leg.

18. The movable utility cart of claim 13, wherein the removable tray assembly includes a bottom surface and the mounting means includes a wall on the bottom surface defining a cavity that receives a top end of the leg.

19. The movable utility cart of claim 18, wherein the mounting means is configured to include means for centering the top end of the leg within the cavity.

20. The movable utility cart of claim 19, wherein the centering means includes a plurality of ribs adjoining an interior surface of the wall defining the cavity.

21. The movable utility cart of claim 19, wherein the centering means includes a plurality of ribs adjoining an interior surface of the wall defining the cavity and a ramp formed on each of the ribs adjacent an opening to the cavity.

22. The movable utility cart of claim 18, wherein the wall is formed to include an opening adjacent to the latch means.

23. The movable utility cart of claim 13, wherein the frame includes a lower portion adjacent to a floor surface and an upper portion spaced apart from the lower portion and further comprising a stationary tray appended to the frame between the lower portion of the frame and the tray assembly.

24. The movable utility cart of claim 23, wherein the tray assembly is appended to the upper portion of the frame.

25. The movable utility cart of claim 24, further comprising a plurality of wheels appended to the lower portion of the frame.

26. The movable utility cart of claim 23, further comprising a second stationary tray appended to the frame between the lower portion of the tray and the tray assembly.

27. A movable utility cart comprising a frame, a removable tray assembly, means for mounting the removable tray assembly to the frame so that the removable tray assembly is connected to the frame, at least one moveable latch, and guide means on the tray assembly for retaining the latch and for guiding movement of the latch between a locked position engaging the frame to couple the removable tray assembly to the frame and an unlocked position disengaging the frame to uncouple the removable tray assembly from the frame.

28. The movable utility cart of claim 27, wherein the frame includes two legs each formed to include a slot and the .latch is positioned to lie in the slots in the locked position.

29. The movable utility cart of claim 28, wherein there are two latches in spaced apart relation each positioned to lie in one of the slots in the locked position.

30. The movable utility cart of claim 29, wherein each slot is formed to include side edges adjacent the slot and each latch includes tapering sides that adjoin the slot edges when the latch is in the locked position.

31. The movable utility cart of claim 27, wherein the frame includes a plurality of legs each formed to include a slot and there are a corresponding number of latches each positioned to lie in one of the slots in the locked position.

32. The movable utility cart of claim 27, wherein the guide means includes a latch plate formed to include a slot and a fastener positioned to lie within the slot and engage the removable tray assembly and latch plate.

33. The movable utility cart of claim 32, wherein the latch plate is configured to include a wall around the slot.

34. The movable utility cart of claim 27, further including actuator means for withdrawing the latch from the locked position.

35. The movable utility cart of claim 34, wherein the actuator means includes a handle coupled to the latch.

36. The movable utility cart of claim 34, wherein there are two latches and the actuator means withdraws both latches from the locked position.

37. The movable utility cart of claim 27, further comprising spring means for biasing the latch so that the latch is urged into the locked position.

38. The movable utility cart of claim 37, wherein the spring means includes a spring positioned to lie within a spring pocket defined by the removable tray assembly and the guide means.

39. The movable utility cart of claim 38, wherein the spring pocket is defined by an upwardly extending flange coupled to the guide means, a downwardly extending flange coupled to the removable tray assembly generally opposite and spaced apart from the upwardly extending flange, and downwardly extending sidewalls coupled to the removable tray assembly and lying on opposing sides of both of the flanges.

40. A movable utility cart comprising a frame, a tray assembly, means for mounting the tray assembly to the frame so that the tray assembly is connected to the frame, a first and second latch, and means for guiding the first and second latch between a locked position engaging the frame to couple the tray assembly to the frame and an unlocked position disengaging the frame to uncouple the tray assembly from the frame, and the frame including four legs each formed to include a slot, and the first and second latches each being positioned to lie in two of the slots in the locked position.

41. A movable utility cart comprising a frame, a removable tray assembly connected to the frame, means for uncoupling the removable tray assembly from the frame so that a user can lift the removable tray assembly off of the frame to disconnect the removable tray assembly from the frame, tray stand means coupled to the removable tray assembly for supporting the removable tray assembly when it is disconnected from the frame so that the removable tray assembly is free-standing and a latch on the tray assembly to removably connect the tray assembly to the frame.

42. The movable utility cart of claim 41, further comprising means for securing the tray stand means in a retracted position adjacent to the removable tray assembly and an extended position supporting the removable tray assembly.

43. The movable utility cart of claim 42, further comprising means on the removable tray assembly for rotatably supporting the tray stand means during movement between the retracted and extended positions.

44. The movable utility cart of claim 41, further comprising means for engaging the tray stand means to secure the tray stand means in a retracted position adjacent to the removable tray assembly.

45. The movable utility cart of claim 44, wherein the engaging means includes a clip and means for attaching the clip to the removable tray assembly so that the clip is movable between a first position contacting the tray stand means to secure the tray stand means in the retracted position and a second position away from the tray stand means.

46. A shelf structure comprising a frame, a tray assembly connected to the frame, means for uncoupling the tray assembly from the frame so that a user can lift the tray off of the frame to disconnect the tray assembly from the frame, and tray stand means coupled to the tray assembly for supporting the tray assembly when it is disconnected from the frame so that the tray assembly is free-standing, means for securing the tray stand means in a retracted position adjacent the tray assembly and an extended position supporting the tray assembly, the tray stand means including a pair of legs each configured to include an axle having a retracted leg retention notch and an extended leg retention notch, and the securing means engages the retracted leg retention notch in the retracted position and the extended leg retention notch in the extended position.

47. A movable utility cart comprising a frame, a tray assembly connected to the frame, means for uncoupling the tray assembly from the frame so that a user can lift the tray off of the frame to disconnect the tray assembly from the frame, and tray stand means coupled to the tray assembly for supporting the tray assembly when it is disconnected from the frame so that the tray assembly is free-standing, means for securing the tray stand means in a retracted position adjacent the tray assembly and an extended position supporting the tray assembly, means on the tray assembly for rotatably supporting the tray stand means during movement between the retracted and extended positions, the tray stand means including a pair of legs each configured to include an axle, the supporting means including an axle support wall on the tray assembly having a notch for each axle, and the securing means couples each tray stand axle in one of the notches of the axle support wall.

48. A movable utility cart comprising a tray, a tray stand configured to include an axle formed to include a retracted leg retention notch and an extended leg retention notch, means for coupling the tray stand to the tray, means formed on the coupling means for alternatively engaging the retracted leg retention notch to secure the tray stand in a retracted position adjacent the tray and an extended position supporting the tray, and a latch on the tray to removably connect the tray to the cart.

49. The movable utility cart of claim 48, further comprising means on the tray assembly for rotatably supporting the axle between the retracted and extended position.

50. The movable utility cart of claim 49, wherein the coupling means includes a body attached to the tray and a clip cantilevered to the body and positioned to lie adjacent the axle.

51. The movable utility cart of claim 50, wherein the engaging means includes a detent on the clip.

52. The movable utility cart of claim 48, wherein the tray stand includes two pairs of legs each configured to include an axle formed to include a retracted leg retention notch and an extended leg retention notch.

53. The movable utility cart of claim 52, wherein each pair of legs is separately movable between the retracted and extended positions.

54. A movable utility cart comprising a tray a tray stand configured to include an axle formed to include a retracted leg retention notch and an extended leg retention notch, means for coupling the tray stand to the tray, and means formed on the coupling means for alternatively engaging the retracted leg retention notch to secure the tray stand in a retracted position adjacent the tray and an extended position supporting the tray, means on the tray assembly for rotatably supporting the axle between the retracted and extended position, the supporting means including a wall being formed to include a notch in which the axle is positioned to lie.

55. A tray assembly comprising a tray a tray stand configured to include an axle formed to include a retracted leg retention notch and an extended leg retention notch, means for coupling the tray stand to the tray, and means formed on the coupling means for alternatively engaging the retracted leg retention notch to secure the tray stand in a retracted position adjacent the tray and an extended position supporting the tray, the tray stand including two pairs of legs each being configured to include an axle formed to include a retracted leg retention notch and an extended leg retention notch, a cross-brace joining each pair of legs being configured to include a raised portion and a means for engaging the raised portion of each cross-brace to secure each pair of legs in a retracted position adjacent the tray.

56. The tray assembly of claim 55, wherein the engaging means includes a flange for each cross-brace and cantilevering means for attaching each flange to the tray so that each flange is movable between a first position adjoining one of the raised portions and a second position away from the raised portion.

* * * * *